United States Patent [19]

Kaswinkel et al.

[11] 4,451,297

[45] May 29, 1984

[54] METHOD FOR REMOVING INORGANIC PARTICULATE SOLIDS FROM BATTERY STRIP

[75] Inventors: K. D. Kaswinkel, Gainesville, Fla.; M. J. Wynn, Latham, N.Y.

[73] Assignee: General Electric Company, Gainesville, Fla.

[21] Appl. No.: 399,570

[22] Filed: Jul. 19, 1982

Related U.S. Application Data

[63] Continuation of Ser. No. 192,290, Sep. 30, 1980, abandoned.

[51] Int. Cl.[3] ..... B08B 1/00; B08B 7/04

[52] U.S. Cl. ..... 134/9; 134/10; 210/765

[58] Field of Search ..... 134/2, 9, 10, 15; 210/521, 765

[56] References Cited

U.S. PATENT DOCUMENTS

| | | | |
|---|---|---|---|
| 2,158,694 | 5/1939 | Fenton | 134/9 |
| 2,359,088 | 8/1944 | Croft | 134/9 |
| 2,372,599 | 3/1945 | Nachtman | 134/9 |
| 3,145,178 | 8/1964 | Dupre et al. | 134/2 |
| 3,425,947 | 2/1969 | Rausch | 134/2 |
| 3,899,427 | 8/1975 | Connelly et al. | 210/521 |
| 4,054,529 | 10/1977 | Pielkenrood | 210/521 |
| 4,310,421 | 1/1982 | West et al. | 210/765 X |
| 4,396,435 | 8/1983 | West et al. | 134/10 |

FOREIGN PATENT DOCUMENTS

| | | | |
|---|---|---|---|
| 2852966 | 10/1979 | Fed. Rep. of Germany | 210/521 |

*Primary Examiner*—Marc L. Caroff

*Attorney, Agent, or Firm*—Pollock, VandeSande & Priddy

[57] ABSTRACT

A method of removing loosely adherent particles from battery strip by brushing the strip at a brushing zone while flowing an aqueous solution of sodium hydroxide over the strip, separating the particles from the resulting suspension and recycling clarified sodium hydroxide solution to the brushing zone.

5 Claims, 2 Drawing Figures

METHOD FOR REMOVING INORGANIC PARTICULATE SOLIDS FROM BATTERY STRIP

This is continuation application Ser. No. 192,290 filed Sept. 30, 1980 now abandoned.

DESCRIPTION

1. Technical Field

This invention is in the general field of processes for making batteries and more particularly relates to processes from cleaning continuous strip material from which battery plates are made.

2. Background Art

In one process for manufacturing nickel-cadmium batteries a perforated strip of mild steel is used as a substrate for a porous nickel layer, the pores of which are filled with nickel hydroxide or cadmium hydroxide. The resulting strip, referred to herein as battery strip, is subjected to a variety of cleaning steps including steps of removing loosely adherent metal and metal hydroxide particles from the surface. In a prior method used to remove these particles the strip material was moved through a brushing station where rotating brushes loosened the particles while deionized water flushed them away. The effluent from this step, containing nickel, nickel hydroxide and cadmium hydroxide was sent to a settling pond where it was mixed with effluents from other steps in the process.

Deionized water at the rate of from 90 to 100 gallons per minute was used in this step and discarded as effluent. This constituted a heavy load on the deionizing system. Furthermore, in this method the nickel and cadmium were mixed with other contaminants in the settling pond, which increased the difficulty of their recovery. A method of reducing the amount of deionized water used in the process was desired, as was a method for efficiently reclaiming nickel and/or cadmium from waste streams.

DESCRIPTION OF THE INVENTION

It is accordingly one object of the invention to provide a method of removing particulate solids from battery strip material which will reduce the amount of deionized water used.

It is another object to provide a method of removing loosely adherent metals and metal compounds from battery strip material which permits ready reclamation of these metals and metal compounds.

Other objects of the invention will become apparent from the following description and the appended claims.

In accordance with this invention a method has been provided for removing and recovering particulate solids from at least one surface of a battery strip comprising flowing an aqueous solution of sodium hydroxide over said surface in a cleaning zone while brushing said surface, thereby carrying loose particles from said surface, collecting the resulting mixture of aqueous sodium hydroxide and suspended particles, separating said suspended particles from said aqueous solution of sodium hydroxide in a settling zone, recycling the aqueous solution of sodium hydroxide to the cleaning zone, and removing said particles from said settling zone.

In the preferred method of carrying out the invention the settling zone comprises a substantially parallel array of vertically-oriented, spaced, corrugated plates through which the suspension is forced in laminar flow.

This settling zone is compact, efficiently removing suspended particles, and providing a clarified effluent which can be recycled with no further treatment.

This invention reduces the amount of deionized water needed for the brush cleaning step to that needed as makeup. The sodium hydroxide solution does not introduce any foreign ions to the battery strip since sodium hydroxide is already present, having been used in other process steps.

The method of separating the solids by settling is efficient and is particularly useful in this process since particles too small to be removed by settling will not adversely affect the process if recycled as a part of the clarified effluent. In the preferred settling method there are no moving parts in the settler, and the settling rate is high enough so that the equipment is compact. The combination of laminar flow and corrugated surfaces achieves a settling rate greater than is believed would be expected, and the presence of sodium hydroxide in concentrations of at least about five percent appears to increase the settling rate over that which would be achieved by settling from water containing no solute. The corrugated surfaces are more effective than planar surfaces in effecting settling. While the mechanism is not known, the corrugations appear to attract and collect solid particles which agglomerate and fall into the collection zone.

BRIEF DESCRIPTION OF THE DRAWINGS

For a better understanding of the invention reference is made to the following description of a preferred embodiment taken in conjunction with the drawings in which.

BEST MODE FOR CARRYING OUT THE INVENTION

This process for cleaning battery strip may be used with liquid solids separators other than settlers, such as centrifuges, and may be used with settling devices other than the one described herein. However, it will be described below with reference to the preferred embodiment.

Figure 1:
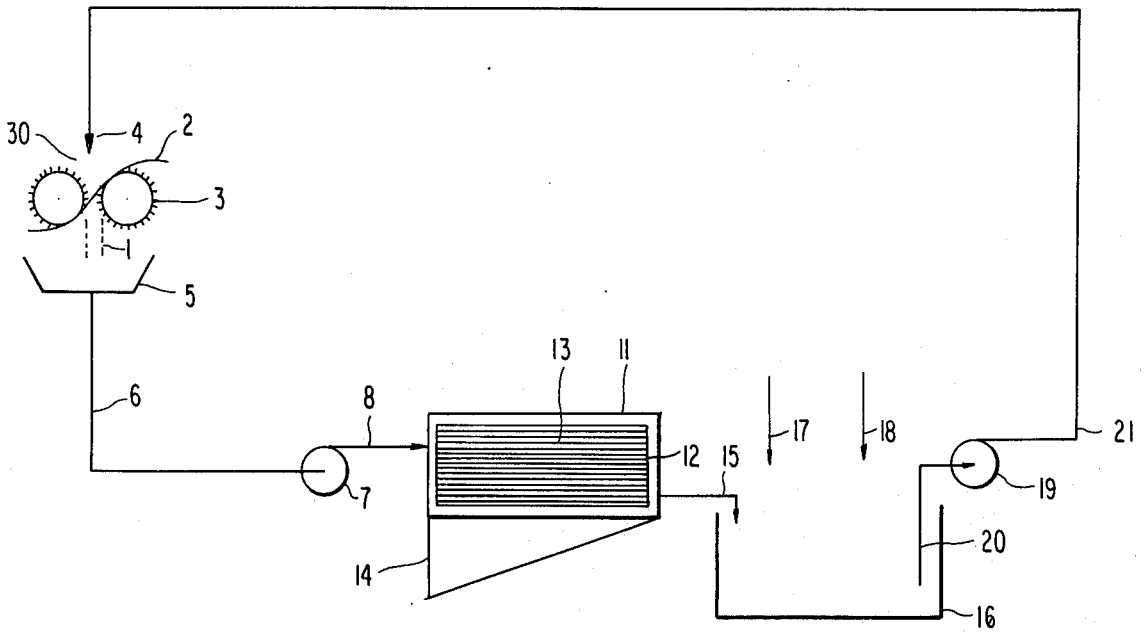
FIG. 1 is a schematic diagram of a system for carrying out the invention.

In FIG. 1 particles 1 are removed from strip 2 by rotating brushes 3 at brush station 30 and are swept from the brushing station 30 by an aqueous solution of sodium hydroxide from fluid outlet 4. The resulting suspension of solids in a sodium hydroxide solution is collected at 5 and conveyed in pipe 6 to pump 7 which forces the suspension through pipe 8 into settling zone 11 through a manifold (not shown). Settling zone 11 contains a plurality of corrugated plates 12. The suspension is pumped through the passageways 13 between plates 12 at a rate sufficiently low so that the flow is laminar. Solids settle into collection zone 14, from which they can be removed as a slurry by means not shown, and the clarified liquid is removed from settling zone 11 through outlet 15. The clarified liquid is collected in tank 16 to which deionized water and/or sodium hydroxide may be added as needed for makeup from lines 17 and 18 respectively. Pump 19 withdraws liquid from tank 16 through inlet 20 as needed and pumps it through line 21 to brush station 30.

Figure 2:
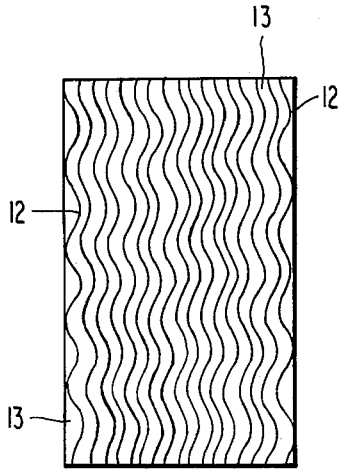
FIG. 2 is a sectional view of an embodiment of a preferred settler for use in this invention.

FIG. 2 shows the assembly of corrugated plates within zone 11. The distance between facing surfaces of the plates within the settling zone may suitably range from about ¼ inch to about 1 inch, and an assembly of plates within zone 11 may contain several sections, each having different spacing. For instance, in one embodiment a section near the inlet may have a spacing of about ½ inch while a section near the outlet may have a spacing of about ¼ inch.

The depth of the corrugations and spacing between crests may each suitably range from about ½ to about 2 inches and is preferably in the range of about 1 to 1½ inches.

In carrying out this invention the flow rate within the settling zone is established to provide for laminar flow and a sufficiently long residence time for solids to settle into the lower portion of the settling zone. The nickel, nickel hydroxide and cadmium hydroxide particles to be separated range in size down to about 5–20 microns, and these particles in a dilute solution of sodium hydroxide are readily removed by settling at a flow rate of about 0.5 to 1.0 feet per minute through a zone about 10 to 15 feet long. Lower flow rates may of course be used. However, the amount of effluent the settler is capable of processing per unit time is reduced proportionately with a reduction in flow rate.

Having described the invention the following Example is offered to illustrate it in more detail:

EXAMPLE

The invention was carried out in a system as shown in the figures. A strip of mild steel about 0.002 inch thick, and 8 inches wide coated on each side with a 0.040 inch layer of porous nickel filled with nickel hydroxide was passed between a pair of rotating brushes while a fluid comprising an aqueous solution of about 5 percent sodium hydroxide was passed at a rate of 6 gallons per minute over the surfaces being brushed. The solution swept away loose nickel and nickel hydroxide particles, and the resulting suspension, almost black in color, was collected and combined with suspensions from other brushing zones to provide a feed of 60 gallons per minute to a settling zone as shown in the figures. This zone was about 30 inches wide, five feet deep and 15 feet long and filled from side to side with vertically-oriented corrugated plates. The plates were spaced about ½ inch apart at the inlet and about ¼ inch apart at the outlet end. The resulting average flow rate through the passageways was about 0.7 feet per minute. The particles settled into the collection zone at the bottom and a liquid, which was slightly cloudy, was passed into a tank from which it was recycled to the brushing zone as needed.

Even though the clarified liquid was cloudy, still containing some particles, any suspended particles which had not been removed did not adversely affect the functions of the clarified liquid at the brushing zone.

While the invention has been described in conjunction with a specific embodiment, alterations will be apparent in light of this description, and it is intended that the invention be limited only as is indicated by the following claims.

We claim:

1. A process for removing essentially inorganic, particulate solids from at least one surface of battery strip carrying loosely adherent particles selected from the group consisting of nickel, nickel hydroxide, and cadmium hydroxide comprising:

brushing said surface in a cleaning zone under conditions whereby said loosely adherent particles are released from said surface, and simultaneously passing an aqueous solution consisting essentially of water and sodium hydroxide over said surface at said brushing zone, said sodium hydroxide being present in a concentration of at least about five percent, thereby lubricating said surface and carrying released particles from said surface as a suspension in said aqueous solution;

collecting the resulting suspension;

separating particles suspended in the aqueous solution of sodium hydroxide from the aqueous solution thereby producing a clarified sodium hydroxide solution; and recycling at least a portion of the resulting clarified sodium hydroxide solution to said brushing zone.

2. A process of removing essentially inorganic particulate solids from at least one surface of a battery strip carrying loosely adherent particles selected from the group consisting of nickel, nickel hydroxide, and cadmium hydroxide, comprising:

brushing at least a portion of said surface in a brushing zone under conditions whereby said loosely adherent particles are released from said surface and simultaneously passing an aqueous solution consisting essentially of water and sodium hydroxide over said surface at said brushing zone, said sodium hydroxide being present in a concentration of at least about five percent, thereby lubricating said surface and carrying said released particles from said surface as a suspension in said aqueous solution;

collecting the resulting suspension;

providing a settling zone comprising fluid inlet means, fluid outlet means, a substantially parallel array of substantially vertically-oriented, spaced plates having corrugated surfaces, and a lower particulate collection zone;

introducing said aqueous solution containing said suspended particles into said settling zone at said inlet means for passage through the passageways in said array defined by the surfaces of said corrugated plates to said outlet means, the flow of said aqueous solution containing suspended particles through said array being maintained at a rate whereby the flow is substantially laminar, whereby a substantial portion of said particles settles into said collection zone and said aqueous solution is clarified;

withdrawing clarified sodium hydroxide-containing liquid from said fluid outlet zone; and recycling at least a portion of the resulting withdrawn clarified liquid to said brushing zone.

3. The method of claims 1 or 2 wherein the aqueous solution contains about five percent sodium hydroxide.

4. The method of claim 2 wherein the facing surfaces of said plates in said array are spaced from about ¼ to about 1 inch apart, and the aqueous solution containing suspended particles flows through said array at a linear rate of less than about one foot per minute.

5. The method of claim 4 wherein the aqueous solution containing suspended particles flows through said array at a linear rate of about 0.5 to one foot per minute, and particles down to about five microns in size are separated from the aqueous solution.

* * * * *